United States Patent [19]

McGurty et al.

[11] 3,970,449

[45] July 20, 1976

[54] HEAT TREATABLE NICKEL-BASE ALLOYS

[75] Inventors: James A. McGurty, Shillington; Paul J. Scherbner, Boyertown, both of Pa.

[73] Assignee: Kawecki Berylco Industries, Inc., Reading, Pa.

[22] Filed: June 13, 1975

[21] Appl. No.: 586,709

[52] U.S. Cl. ..... 75/170; 148/32

[51] Int. Cl.² ..... C22C 19/03

[58] Field of Search ..... 75/170, 171; 148/32, 148/32.5

[56] References Cited

UNITED STATES PATENTS 3,287,110 11/1966 Scherbner ..... 75/170

*Primary Examiner*—R. Dean

*Attorney, Agent, or Firm*—Pennie & Edmonds

[57] ABSTRACT

A heat treatable nickel-base alloy consisting essentially of between about 0.6 to 3.0 weight percent beryllium, between about 0.0 to 4.5 weight percent titanium, between about 0.0 to 4.5 weight percent zirconium, between about 0.0 to 4.5 weight percent hafnium, between about 0.01 to 1.0 weight percent of a rare earth element, and the balance nickel.

3 Claims, No Drawings

HEAT TREATABLE NICKEL-BASE ALLOYS

BACKGROUND OF THE INVENTION

This invention relates to nickel-base alloys which can be hot worked without cracking.

It is known that nickel-base alloys containing beryllium at levels of about 2 weight percent are precipitation hardenable. The annealed condition of such alloys is obtained by heating to a temperature of 1800°–2000°F. followed by water quenching. In this condition, the alloy is soft (R/C-10), ductile, and malleable and readily fabricated, formed, or machined. The hardened condition is obtained by tempering the annealed structure at temperatures between 800° and 1000°F.; particularly, at 925°–950°F. for 1½ hours. In this condition, the annealed structure is not only hardened, but has good strength and ductility. The strength of this alloy can be further increased by the addition of titanium without adversely affecting the ductility of the alloy in the hardened state. Such a nickel-base alloy is, for example, illustrated in U.S. Pat. No. 3,287,110.

Industrial needs, however, require the production of wide sheets of such nickel-base alloys starting from cast billets having a cross-section in excess of 1 foot square and weighing 1,000 pounds. Utilizing the known nickel-beryllium-titanium alloys to form such sheets using standard steel industry hot rolling practice has resulted in cracks developing in the castings during such working. Such alloys are somewhat hot short which, it is believed, might be due in some measure to interstitial impurities in the metal, in particular, sulfur. Such billets because of this cracking are unsuitable for hot working and, in fact, it has been noted that their cold workability and resistance to grain growth at elevated temperatures are not satisfactory.

SUMMARY OF THE INVENTION

The present invention provides an improved nickel-base alloy which can be hot worked and which also has improved cold workability and resistance to grain growth at elevated temperatures.

The foregoing objects are achieved according to the present invention by a novel alloy consisting essentially of between about 0.6 to 3.0 weight percent beryllium, between about 0.0 to 4.5 weight percent titanium, between about 0.0 to 4.5 weight percent zirconium, between about 0.0 to 4.5 weight percent hafnium, between about 0.01 to 1.0 weight percent of a rare earth element, and the balance nickel. The preferred alloy is one utilizing yttrium.

For the purposes of the instant application, the phrase "rare earth element" is meant to be synonomous with the term rare earth metals and to include those elements beginning with Atomic No. 57 (lanthanum) to Atomic No. 71 (lutetium) and also including yttrium. While yttrium, strictly speaking, is not a rare earth metal, it is considered to be a member of the group and, for the purposes of the instant invention, the rare earth metals are deemed to be equivalent to the yttrium, although the yttrium is still the preferred metal.

DETAILED DESCRIPTION

In a generally preferred embodiment of the invention, the alloy, which can be formulated from its component elements by alloying procedures known in the art, consists essentially of between about 0.6 to 3.0 weight percent beryllium, between about 0.0 to 4.5 weight percent titanium, between about 0.0 to 4.5 weight percent zirconium, between about 0.0 to 4.5 weight percent hafnium, between about 0.01 to 1.0 weight percent of a rare earth element, and the balance nickel.

Preferred alloy compositions within the scope of the present invention are those utilizing yttrium in an amount of about 0.20 weight percent. A preferred composition is:

| Component | Weight Percent |
|---|---|
| Beryllium | 2.0 |
| Titanium | 0.4 |
| Yttrium | 0.20 |
| Nickel | Balance |

It will be understood that, though nickel is the desired element, minor amounts of cobalt are always found in commercially available nickel regardless of the purity of the nickel. Thus, the purest nickel may contain as much as 0.03 weight percent cobalt. Such contaminating cobalt is not necessary in the instant invention, does not adversely affect the instant alloy, and this comment as to its presence is simply to make clear its association with commercially available nickel.

DESCRIPTION OF PREFERRED EMBODIMENTS

The following examples are provided for the purpose of further illustrating, but not limiting, the present invention and its attendant advantages. All parts and percentages are by weight unless otherwise indicated.

EXAMPLE 1

Two 600 pound heats were melted and cast into square cross-section molds approximately 7 inches square. Both heats were made using virgin materials and had the following composition:

| Component | Weight Percent Heat A | Heat B |
|---|---|---|
| Beryllium | 2.0 | 2.0 |
| Titanium | 0.4 | 0.4 |
| Yttrium | — | 0.2 |
| Nickel | Balance | Balance |

Both ingots were hot rolled from a furnace preheat temperature of 1975°±25°F. to strips 0.2 inch thick by 6½ inches wide. Two furnace reheats were used.

The strip of the alloy which contained the yttrium addition was of excellent quality. That of the non-yttrium bearing heat was rejected because of extensive edge cracking.

EXAMPLE 2

Two 1300 pound heats were melted and cast into round cross-section molds approximately 12 inches in diameter. Both heats were made using virgin materials and had the following compositions:

| Component | Weight Percent Heat C | Heat D |
|---|---|---|
| Beryllium | 2.0 | 2.0 |
| Titanium | 0.4 | 0.4 |
| Yttrium | — | 0.2 |
| Nickel | Balance | Balance |

Both ingots were hot rolled from a furnace preheat temperature of 1975°±25°F. to strips 0.2 inch thick by 9½ inches wide. Two furnace reheats were used.

The strip of the alloy which contained the yttrium addition was of excellent quality, while that of the nonyttrium bearing heat was rejected because of extensive hot cracking.

A comparison of the properties of the alloy compositions of the foregoing examples, with and without a 0.2 weight percent yttrium, established that the yttrium addition has no deleterious effect on properties of the alloy. Investigated were cold workability, weldability, physical properties, and ambient and elevated temperature mechanical properties. On the contrary, it was discovered that the yttrium addition very markedly restricts grain growth of the alloy at elevated temperatures (as in heat treating and hot working). It was found that the yttrium-bearing alloys, after solution heat treatment, were of a substantially finer grain structrue than that of the non-yttrium bearing alloys. These fine grain yttrium-bearing alloys as compared to the non-yttrium bearing alloys were found to possess superior cold formability and fabricability.

It will be understood that minor amounts of other elements, such as silicon, aluminum, magnesium, and chromium can be present in the alloys of the present invention without adversely affecting their cold workability, heat workability, or resistance to grain growth.

While the invention has been described in connection with a preferred embodiment, it is not intended to limit the invention to the particular form set forth, but, on the contrary, it is intended to cover such alternatives, modifications and equivalents as may be included within the spirit and scope of the invention as defined by the appended claims.

What is claimed is:

1. A heat treatable nickel-base alloy consisting essentially of between about 0.6 to 3.0 weight percent beryllium, between about 0.0 to 4.5 weight percent titanium, between about 0.0 to 4.5 weight percent zirconium, between about 0.0 to 4.5 weight percent hafnium, between about 0.01 to 1.0 weight percent of a rare earth element, and the balance nickel.

2. An alloy according to claim 1 wherein the rare earth element is yttrium.

3. An alloy according to claim 1 consisting essentially of 2 weight percent beryllium, 0.4 weight percent titanium, 0.2 weight percent yttrium, and the balance nickel.

* * * * *